US005918097A

United States Patent [19]

Kagawa et al.

[11] Patent Number: 5,918,097

[45] Date of Patent: Jun. 29, 1999

[54] TONER IMAGE FIXING DEVICE

[75] Inventors: Toshiaki Kagawa; Toshihiro Tamura, both of Sakurai; Shogo Yokota, Fujiidera, all of Japan

[73] Assignee: Sharp Kabushiki Kaisha, Osaka, Japan

[21] Appl. No.: 08/770,237

[22] Filed: Dec. 20, 1996

[30] Foreign Application Priority Data

Dec. 28, 1995 [JP] Japan ..... 7-343079

[51] Int. Cl.[6] ..... G03G 15/20

[52] U.S. Cl. ..... 399/333; 219/216

[58] Field of Search ..... 399/320, 324, 399/333; 219/469–471, 216; 432/60; 118/60

[56] References Cited

U.S. PATENT DOCUMENTS

| | | | |
|---|---|---|---|
| 4,272,179 | 6/1981 | Seanor | 399/324 |
| 4,853,737 | 8/1989 | Hartley et al. | 399/333 |
| 4,859,831 | 8/1989 | Webb | 219/216 |
| 4,934,930 | 6/1990 | Soga | 399/324 X |
| 5,123,151 | 6/1992 | Uehara et al. | 399/333 X |
| 5,291,257 | 3/1994 | Cerrah et al. | 399/333 |
| 5,547,759 | 8/1996 | Chen et al. | 399/320 X |
| 5,724,638 | 3/1998 | Isogai et al. | 399/324 X |

FOREIGN PATENT DOCUMENTS

| | | |
|---|---|---|
| 0 313 023 A2 | 4/1989 | European Pat. Off. . |
| 19600211A1 | 9/1996 | Germany . |
| 55-36996 | 9/1980 | Japan . |
| 1-304481 | 12/1989 | Japan . |
| 8-241000 | 9/1996 | Japan . |

*Primary Examiner*—S. Lee

*Attorney, Agent, or Firm*—David G. Conlin; George W. Neuner

[57] ABSTRACT

A toner image fixing device possesses excellent toner-releasing property and paper-carrying ability. A fixing roller is covered with a layer of compound of PTFE and fluoroelastomer.

7 Claims, 3 Drawing Sheets

FIG.3
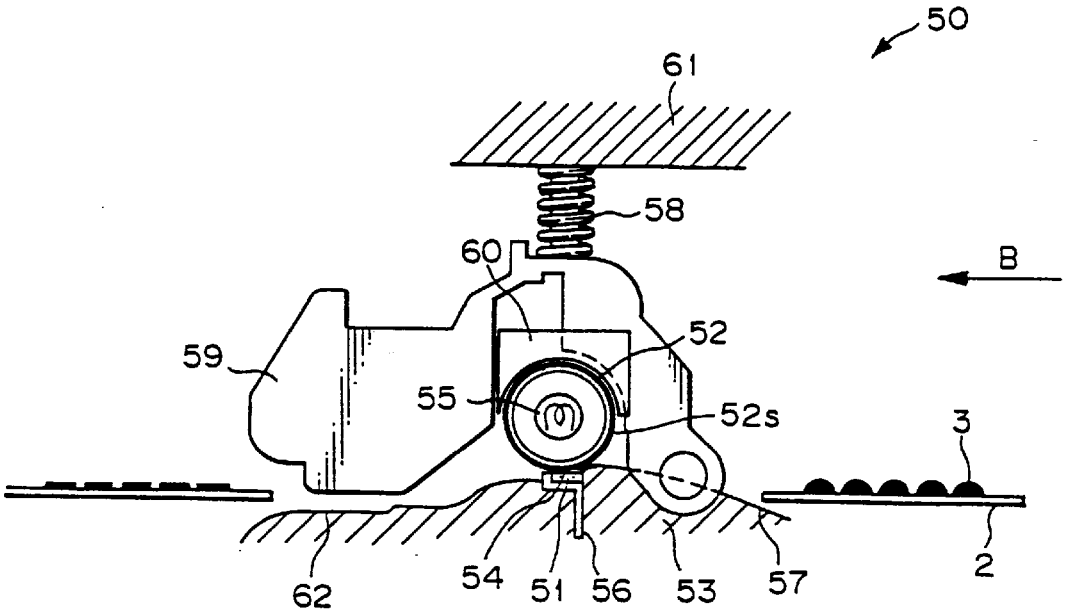
FIG.4
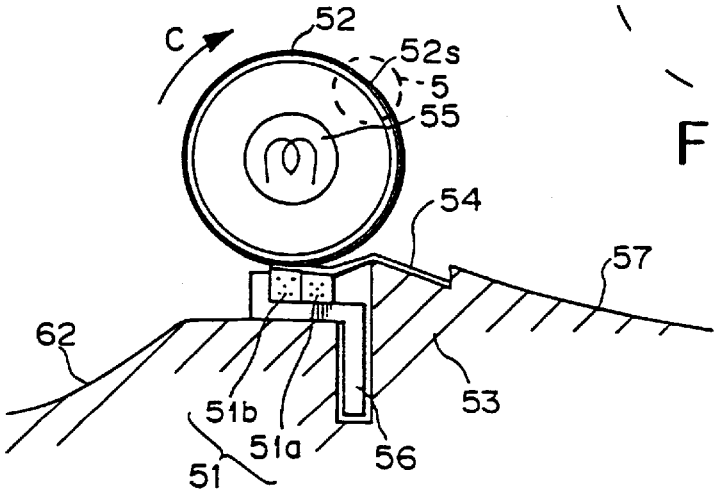
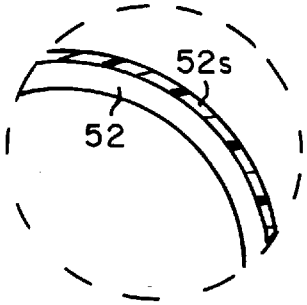
FIG. 5

TONER IMAGE FIXING DEVICE

BACKGROUND OF THE INVENTION

The present invention relates to a toner image fixing device that is used in electrophotographic copying machines, facsimiles, printers and the like machines using electrophotographic process.

In conventional electrophotographic copying machines, facsimiles, printers and the like machines using electrophotographic process, there is usually used such a toner image fixing device that fixes a toner image on a recording material passing through nip portion formed between a fixing roller and a pressure roller, by heating either one or both rollers (hereinafter called as pressure roller type). In the pressure-roller type fixing device, paired rollers must rotate in synchronism with each other and must be rotatably supported. Therefore, the device has a complicated construction and is large and expensive to manufacture.

To solve the above-mentioned problems, the present applicant proposed a toner image fixing method that fixes a toner image on recording paper transferring through nip portion formed between a fixing roller and non-rotating pressure member used instead of a pressure roller (Japanese Patent Application No. 7-44647). This method is hereinafter called as pressure pad type.

A pressure pad type toner image fixing device has a fixing roller and a pressure member disposed under the fixing roller. The fixing roller is comprised of a thin-wall aluminum cylinder whose external surface is coated all over with well-releasable, paper-guiding heat-resistant synthetic resin, e.g., heat-resistant silicone rubber having a large friction coefficient. Furthermore, the pressure and pad type toner image fixing device has a pressure member disposed under the fixing roller. A heat-resistant sheet on a lower frame which is interposed between the pressure member and the fixing roller. The heat-resistant sheet is made of a 100 micron thick glass fiber base coated or impregnated with well-releasable and heat-resistant synthetic resin, e.g., fluorocarbon resin: PFA (Tetrafluoroethylene-fluoroalkylvinylether copolymer), PTFE (Polytetrafluoroethylene) and FET (Polytetrafluoroethylene-Polytetrafluoropropylene copolymer). A recording paper with an unfixed toner image developed thereon passes nip portion formed between the fixing roller and the heat-resistant sheet for fixing the toner image thereon by fusing. The pressure-pad type fixing device involves such a problem that the fixing roller must have a toner-releasable property and a paper carrying property but could not yet satisfy both requirements because these two properties are contrary to each other.

SUMMARY OF THE INVENTION

In view of the foregoing, it is an object of the present invention to provide a toner image fixing device which can well release from toner particles and smooth transport a recording paper and method of manufacturing said fixing device.

It is an object of the present invention to provide a toner image fixing device which comprises a fixing roller, a pressure member disposed to press against an outer circumferential surface of the fixing roller, and a heat-resistant sheet interposed between the fixing roller and the pressure member, said heat-resistant sheet being pressed by the pressure member against the fixing roller to form nip for fixing an unfixed toner image on a recording medium by the fixing roller while the recording medium passing therethrough, and which is characterized in that the fixing roller is covered with a coat of polytetrafluoro-ethylene (PTFE) compounded with fluoroelastomer.

It is another object of the present invention to provide a method of manufacturing a toner image fixing device comprising a fixing roller covered with a coat of polytetrafluoroethylene (PTFE) compounded with fluoroelastomer, a pressure member disposed to press against an outer circumferential surface of the fixing roller and a heat-resistant sheet interposed between the fixing roller and the pressure member, said heat-resistant sheet being pressed by the pressure member against the fixing roller to form nip for fixing an unfixed toner image on a recording medium by the fixing roller while the recording medium passing therethrough, characterized in that the coat of the fixing roller is formed by baking at a temperature of 340° C. to 380° C. for 20 minutes or more.

It is another object of the present invention to provide a method of manufacturing a toner device which comprises a fixing roller covered with a coat of polytetrafluoroethylene (PTFE) compounded with fluoroelastomer, a pressure member disposed to press against an outer circumferential surface of the fixing roller and a heat-resistant sheet interposed between the fixing roller and the pressure member, said heat-resistant sheet being pressed by the pressure member against the fixing roller to form nip for fixing an unfixed toner image on a recording medium by the fixing roller while the recording medium passing therethrough, and which is characterized in that the manufacturing method includes a process for lapping the coat of the fixing roller by a lapping film having a particle size of not more than 15 microns is included.

It is another object of the present invention to provide a method of manufacturing a toner device which comprises a fixing roller covered with a coat of polytetrafluoroethylene (PTFE) compounded with fluoroelastomer, a pressure member disposed to press against an outer circumferential surface of the fixing roller and a heat-resistant sheet interposed between the fixing roller and the pressure member, said heat-resistant sheet being pressed by the pressure member against the fixing roller to form nip for fixing an unfixed toner image on a recording medium by the fixing roller while the recording medium passing therethrough, and which is characterized in that the manufacturing method includes a process for relapping the coat of the fixing roller by a lapping film having a particle size of not more than 12 microns after the process for lapping the coat of the fixing roller by a lapping film having a particle size of 15 to 30 microns.

BRIEF DESCRIPTION OF THE DRAWINGS

FIG. 3 is a detailed view showing essential portions of the toner image fixing device according to the present invention.

FIG. 4 is a diagrammatic construction view of a laser printer in which a toner-image fixing device according to the present invention is used.

FIG. 5 is an exploded view of the section in the balloon in FIG. 4 illustrating that the layer 52*s* of roller 52 is a polymer material.

PREFERRED EMBODIMENT OF THE INVENTION

Figure 1:
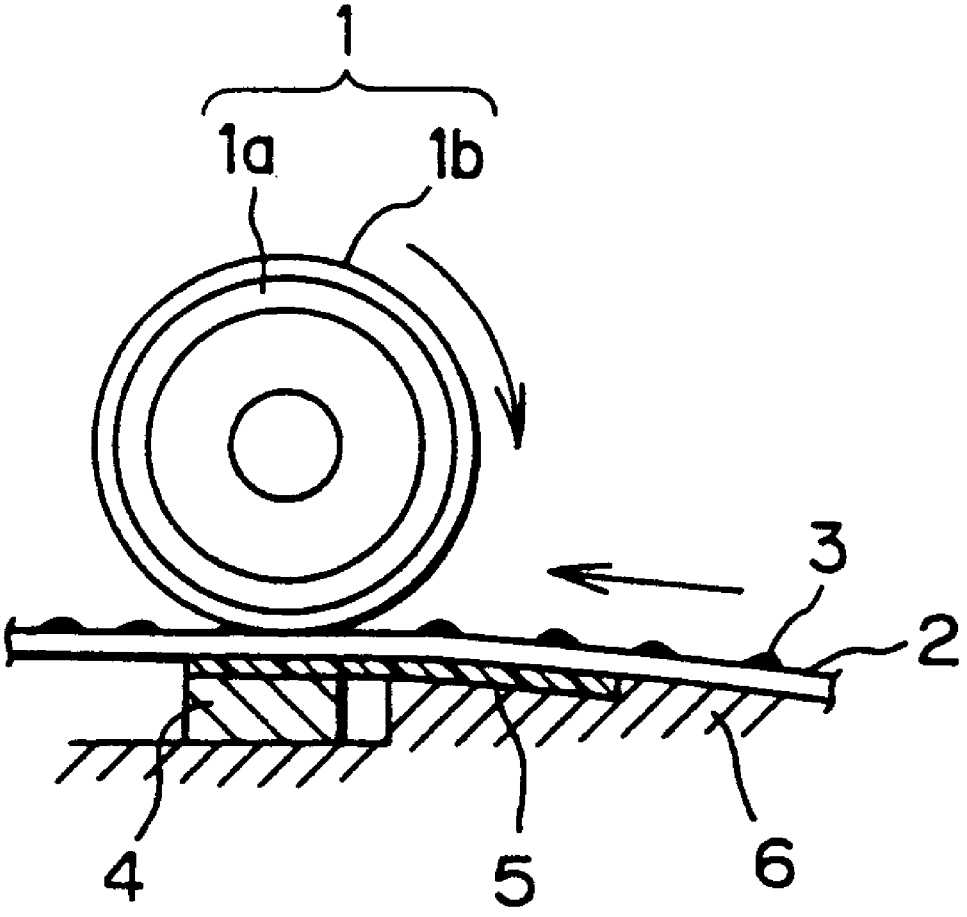
FIG. 1 ( PRIOR ART )
FIG. 1 is a construction view of a toner image fixing device using a pressure pad system that was previously proposed by the present applicant.

Referring to FIG. 1, an example of a pressure pad type toner image fixing device is explained as follows:

A fixing roller 1 is a thin-wall aluminum cylinder 1*a* whose external surface is coated all over with well-releasable, paper-guiding heat-resistant synthetic resin 1*b*, e.g., heat-resistant silicone rubber having a large friction coefficient. A pressure member 4 is disposed under the fixing roller 1. A heat-resistant sheet 5 on a lower frame 6 is interposed between the pressure member 4 and the fixing roller 1. The heat-resistant sheet 5 is made of a 100 micron thick glass fiber base coated or impregnated with well-releasable and heat-resistant synthetic resin, e.g., fluorocarbon resin: PFA (Tetrafluoroethylene-fluo-roalkylvinylether copolymer), PTFE (Polytetrafluoro-ethylene) and FET (Polytetrafluoroethylene-Polytetra-fluoropropylene copolymer). A recording paper 2 with an unfixed toner image 3 developed thereon passes nip portion formed between the fixing roller 1 and the heat-resistant sheet 5 for fixing the toner image thereon by fusing.

The pressure-pad type fixing device involves such a problem that the fixing roller must have a toner-releasable property and a paper carrying property but could not yet satisfy both requirements because these two properties are contrary to each other.

Features of the fixing device and the manufacturing methods according to the present invention are as follows:

A toner image fixing device according to the present invention can have a satisfactory ability to carry recording paper as well as a satisfactory ability to release toner particles.

The method of manufacturing a toner device can produce a covering coat of the fixing roller, which coat has a stabilized toner releasability and a satisfactory wear resistance.

The method of manufacturing a toner device can remove protrusions from the covering coat of the fixing roller without impairing the surface quality, which coat can prevent the deterioration of toner releasability by aging and prevent high-temperature toner-offset.

The method of manufacturing a toner device can remove large protrusions from the covering coat of the fixing roller without decreasing the toner-releasability and can therefore improve the yields of fixing roller products, resulting in low production cost.

Referring FIGS. 2 to 4, a preferred embodiment of the present invention will be described as follows:

However, the following description relates to the case when a toner fixing device according to the present invention is used in a laser printer.

Figure 2:
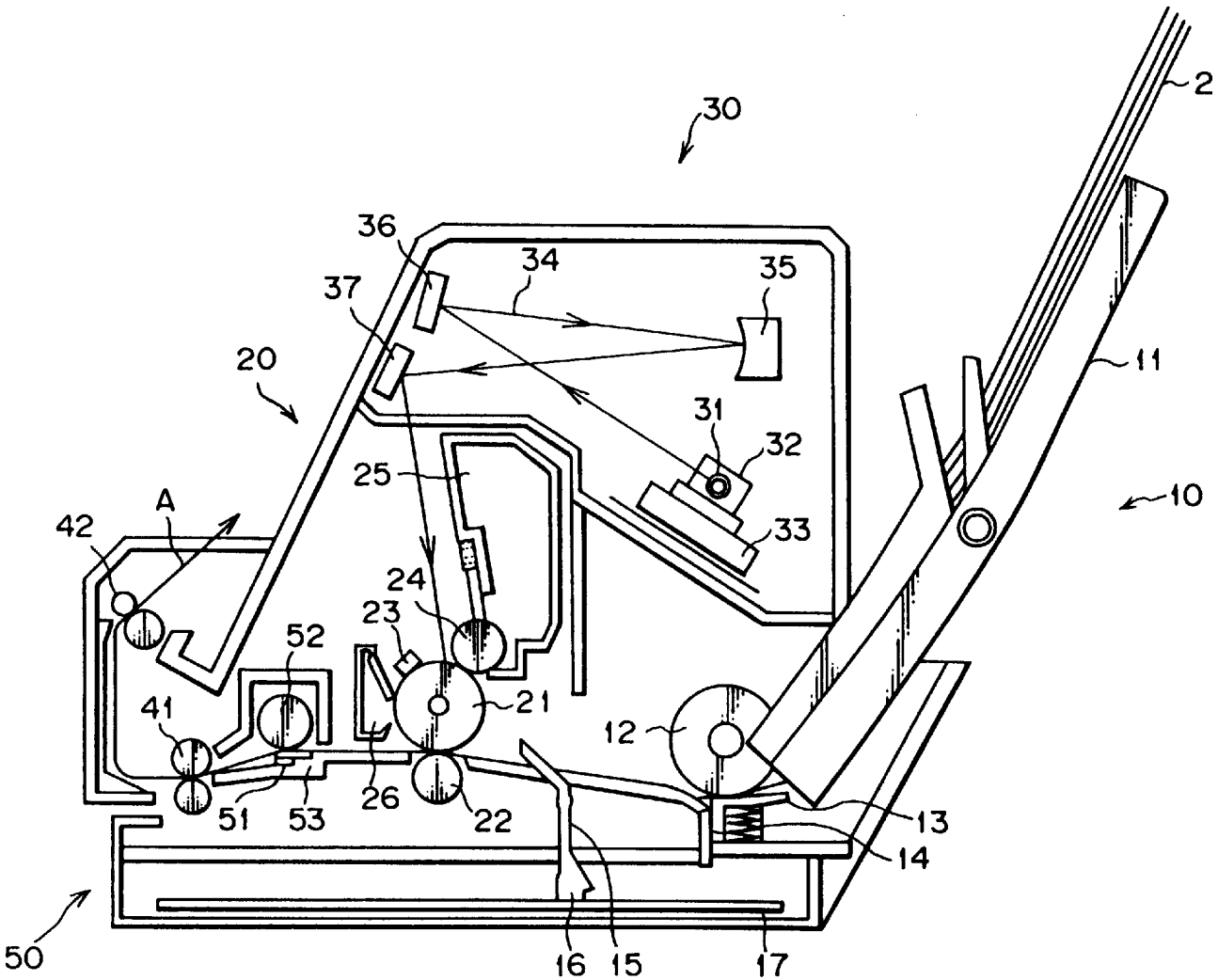
FIG. 2 is a general view of a toner image fixing device according to the present invention.

As shown in FIG. 2, the laser printer has a paper feeding portion 10, an image forming device 20, a laser scanning portion 30 and a toner image fixing device 50 embodying the present invention.

The paper feeding portion 10 feeds recording paper 2 into the image forming device 20 disposed in the printer body. The image forming device transfers a toner image onto the recording paper 2 that is further fed to the toner fixing device 50 wherein the toner image is fixed by heat on the recording paper 2. The recording paper with a toner image fixed thereon is then delivered out of the printer by delivery rollers 41 and 42. The path along which the recording paper traveled in the printer is shown by a bold line with an arrow A in FIG. 2.

The paper feeding portion 10 is composed of a paper feeding tray 11, a paper feeding roller 12, paper separating friction plate 13, pressure spring 14, paper sensor actuator 15, a paper sensor 16 and a control circuit.

When a command "Print" is given to the paper feeding portion 11, recording paper 2 piled on a paper feeding tray 11 is fed one by one by the effect of the paper feeding roller 12, paper feeding friction plate 13 and pressure spring 14 into the body of the printer. In the printer, the recording paper 2 kicks down the paper sensor actuator 15 that causes the optical paper-sensor 16 to generate an electrical signal to start an image printing process. The control circuit 17 driven by the section of the paper sensing actuator 15 transmits an image signal to a light-emitting laser diode unit 31 of the laser scanning portion 30 and controls the ON-OFF operation of the light-emitting diodes.

The laser scanning portion 30 comprises a light-emitting. laser-diode unit 31, a scanning mirror 32, a scanning mirror motor 33 and reflecting mirrors 35, 36 and 37.

The scanning mirror 32 is driven by the scanning mirror motor 33 to rotate at a high constant rotation speed. In FIG. 2, laser light 34 scans in a vertical direction relative to the paper surface. The laser light 34 emitted from the light-emitting laser-diode unit 31, reflects by the reflecting mirrors 36, 35 and 37 in turn and falls onto a light-sensitive body 21. At this time, the laser light 34 selectively exposes the surface of the light-sensitive body 21 according to ON-OFF information given from the control circuit 17.

The image forming device 20 is composed of a light-sensitive body 21, an image transfer roller 22, an electrically charging member 23, a developing roller 24, a developing unit 25 and a cleaning unit 26.

The light-sensitive body surface electrically charged in advance by the electrically charging member 23 is selectively discharged by the laser light 34 to form a latent image thereon. In the developing unit 25, toner stored therein is electrically charged by suitable stirring and is then fed to the developing roller 24 by which a toner image is formed on the light-sensitive body 21 according to the static latent image by the effect of a developing bias voltage given to the developing roller 24 and an electric field produced by potentials on the light-sensitive body 21.

The recording paper 2 fed by the paper feeding portion 10 enters a path between the light-sensitive body 21 and the image transfer roller 22. An image developed with toner on the light-sensitive body 21 is transferred onto the recording paper 2 by the effect of an electric field produced by a voltage applied to the image transfer roller 22 when the paper passes the path between the light-sensitive body 21 and the image transfer roller 22. The toner on the light-sensitive body 21 is transferred by the image transfer roller 22 to the recording paper 2 and unused toner is collected by the cleaning unit 26.

The recording paper 2 carrying the transferred thereon toner image is then fed to a toner image fixing device 50 wherein the recording paper 2 is suitably pressed by a pressure member 51 and, at the same time, is heated by a fixing roller 52 whose surface is heated and kept at a constant temperature of 155° C. The toner image is thus fixed by fusing on the recording paper 2. The recording paper 2 with the fixed toner image is delivered by the delivery rollers 41 and 42 out of the printing machine.

Referring to FIGS. 3 and 4, the above-mentioned toner-image fixing device 50 is described in detail as follows:

FIG. 3 is a general view of the toner image fixing device 50 and FIG. 4 is a detailed view of an essential portion of the toner-image fixing device 50.

As shown in FIG. 3, the toner fixing device 50 has a pressure member 51, a fixing roller 52 and a lower frame 53. The fixing roller 52 has a thin-wall aluminum cylindrical body (outside diameter 14 mm and wall thickness 0.55 mm) externally covered with a layer 52*s* of synthetic resin having an excellent toner-releasability and a high heat-resistance. A heater-lamp 55 is coaxially inserted in the fixing roller body. The fixing roller 52 is supported at both ends on semi-circular bearings 60 disposed at right angles to the fixing roller axis. The bearings 60 are fitted in a fixing cover 59 made of heat-resistant resin. The fixing cover 59 is pressed through pressure springs 58 (pressing force 1200 gf each) by an upper frame 61.

As shown in FIG. 4, the pressure member 51 is composed of two elastic members, one of which is a 2 mm thick and 2 mm wide silicon sponge-rubber member 51*a* disposed at an upstream side of the paper feeding path and the other is a 3 mm thick and 2 mm wide silicon sponge-rubber member 51*b* disposed at the downstream side of the paper feeding path. These pressure members 51*a* and 51*b* are arranged between a Z-shape metal plate 56 (1.2 mm thick plate of stainless steel SUS304) and an external cylindrical surface of the fixing roller 52 and pressed against the fixing roller by the force of the pressure springs 58. The pressure members 51*a* and 51*b* are secured to the Z-shape metal plate 56 by using a double coated adhesive tape (ET tape produced by Nissan Packing Company). The Z-shape metal plate 56 is engaged with bosses formed on the lower frame 53 at it's both ends.

The above-mentioned construction of the pressure member 51 is adopted for: (1) increasing the fixing ability by increasing nip width and (2) easily catching a front edge of paper by decreasing pressure to the upstream side pressure member. The Z-shape of the metal plate 56 is to increase its strength and prevent the pressure member from falling down when paper passes the fixing device. The pressure member 51 will be referred hereinafter to as a stepped-type pressure member.

A heat-resistant sheet 54 is secured to the lower frame 53 by a heat-resistant double-coated adhesive tape and inserted between the pressure member 51 and the fixing roller 52.

In the above-mentioned toner-image fixing device 50, the fixing roller 52 rotates in the direction C indicated by an arrow, being heated internally by the heater-lamp 55 and controlled by a control unit (not shown) to keep its surface temperature at 155° C. A recording paper 2 carrying a developed and unfixed toner image 3 thereon enters into nip portion of the fixing device (in the section indicated by an arrow B in FIG. 3). The recording paper 2 is advanced by rotation of the fixing roller 52 since a frictional force between the fixing roller 52 and the recording paper 2 is larger than a frictional force between the recording paper 2 and the heat-resistant sheet 54. The toner image is fixed by heat on the recording paper while the paper passes the fixing device.

The covering coat 52*s* of the fixing roller, which is a feature of the present invention, will be described below:

In the above-mentioned toner-image fixing device, the fixing roller 52 must have an excellent toner-releasing ability as well as an excellent ability to transfer recording paper in the paper passing direction. Accordingly, materials for making the coat 52*s* of the fixing roller were tested and studied from the view point that it can satisfy the above-mentioned requirements. The test results are shown in Table 1. The tested materials for covering the fixing roller are: fluorocarbon resin (PTFE, PFA, FEP), silicon rubber (LTV) and compound of fluorocarbon resin and fluoroelastomer (PTFE+Fluoroelastomer, PFA+Fluoroelastomer, FEP+Fluoroelastomer).

TABLE 1

| Material | Paper Transfer Ability | Toner Releas-ability | Torque | Wear Resis-tance |
|---|---|---|---|---|
| PTFE | x | ○ | ○ | ○ |
| PFA | x | ○ | ○ | ○ |
| FEP | x | ○ | ○ | ○ |
| Slicon Rubber (LTV) | ○ | ○ | x | Δ |
| PTFE + Fluoro-elastomer | ○ | ○ | ○ | ○ |
| PFA + Fluoro-elastomer | 0 | 0 | 0 | Δ |
| FEP + Fluoro-elastomer | ○ | Δ | ○ | x |

The paper transfer ability of each material was tested with various kinds of paper (plain paper, envelop, paper of 52 g/m$^2$, paper of 128 g/m$^2$, OHP, label paper). Material that could transport all kinds of paper with no trouble is indicated with a mark ○ (Good). Material that caused any kind of trouble, e.g,. mis-nipping, slipping and so on is indicated with a mark x (Bad).

The toner-releasability of material is judged according to temperature Tho at which high-temperature toner offset occurred:

○ (Good) if Tho is equal to or over 190° C. (Tho≧190);

Δ (Mean) if Tho is not lower than 150° C. but lower than 190° C. (150° C.≦Tho<190° C.); and x (Bad) if Tho is lower than 155° C. (Tho<155° C.).

The torque value T was evaluated as:

○ (Good) if T is not more than 400 gfcm (T≦400 gfcm);

Δ (Mean) if T exceeds 400 gfcm but not mpre than 600 gfcm (400 gfcm<T≦600 gfc); and x (Bad) if T is more than 600 gfcm (600 gfcm<T).

The wear resistance of each material was tested on a wear-testing machine and evaluated by wearing loss Cr of the coat as follows:

○ (Good) if wear loss Cr is not more than 1.5 μm (Cr≦1.5 μm);

Δ (Mean) if Cr exceeds 1.5 μm and not larger than 5 μm (1.5<Cr≦5 μm); and x (Bad) if Cr is more than 5 μgfcm (5 μm<Cr).

Table 1 indicates the following facts:

Fluorocarbon resin used for covering a fixing roller for use in the conventional pressure roller type fixing system possesses excellent toner-releasability and wear-resistance but has a very small friction factor, i.e., it can not obtain a necessary paper-transferring ability of a fixing roller for pressure-pad type fixing system.

Silicon rubber has a sufficient ability to transfer recording paper but has an excessive frictional force that may cause an excessively large torque of the fixing device.

Fluorocarbon resin plus fluoroelastomer compounds possess most balanced properties concerning the paper transferring ability, toner releasability and torque value. Among them, PTFE compounds have also an excellent wear resistance. The PTFE-fluoroelastomer compounds having a PTFE content of 40 to 60% by weight are particularly desirable. Accordingly, the present embodiment makes the coat 52*s* of the fixing roller 52 by such a process that a compound containing 50% PTFE by weight and 50% fluoroelastomer by weight is prepared and a 10 μm thick coat 52*s* of the compound was applied to the external cylindrical surface of the fixing roller 52 and baked.

Conditions for baking the coat 52*s* of the fixing roller 52 was studied, The coat 52*s* is a 10 μm thick coat of 50% PTFE and 50% fluoroelastomer compound applied to the fixing roller. The test results are shown in Table 2.

TABLE 2

| Baking Temperature ° C. | Baking Time Min. | Paper Transferring Ability (Carrying Power) (gf) | Toner Releasability | Wear Resistance |
|---|---|---|---|---|
| 320 | 30 | ○ (260) | Δ | ○ |
| 340 | 30 | ○ (267) | ○ | ○ |
| 360 | 30 | ⬯ (327) | ⬯ | ⬯ |
| 380 | 30 | ○ (304) | ○ | ○ |
| 360 | 10 | ○ (350) | Δ | Δ |
| 360 | 20 | ○ (335) | ○ | ○ |
| 360 | 40 | ○ (320) | ○ | ○ |
| 360 | 60 | ○ (315) | ⬯ | ⬯ |

The same criteria that described for Table 1 are applied to Table 2 for the items "Paper transferring ability", "Toner releasability" and "Wear Resistance".

Table 2 teaches the followings:

The compound baked at a relatively low temperature (320° C.) has a decreased toner releasability because of insufficient melting of PTFE therein. For the same reason, the compound baked for a relatively short time (10 minutes) is inferior in toner-releasability and wear resistance. Compounds baked for longer time can obtain stabilized toner-releasability and wear resistance but the production efficiency is decreased. In view of dispersions of baking conditions and production efficiency, the optimal baking conditions are determined as follows:

Baking temperature: 340° C.–380° C.

Baking time: 20–40 min.

These conditions were obtained for the compound of PTFE and fluoroelastomer in the ratio 1:1 but the similar results were also obtained for compounds of PTFE and fluoroelastomer compounds in the ratios of 4:6 to 6:4. Accordingly, the present embodiment decides baking of the compound at 360° C. for 30 minutes.

A lapping method for lapping the coat 52*s* of the fixing roller 52 was studied.

The fixing roller 52 used in this embodiment is a small diameter roller made of aluminum having an outer diameter of 14 mm and a thin wall of 0.55 mm, which is designed to minimize a rising time to reach a specified fixing temperature. When a coat 52*s* is applied by splaying to the fixing roller 52, solids contained in compound or agglomerates in a sprayer from small protrusions on the coat 52*s* of the fixing roller 52. These small protrusions of the coat 52*s* of the fixing roller may cause non-uniformity of toner-image fixing and must be removed after baking process. A coated surface of a conventional fixing roller which has a wall thickness of 1.5 mm or more and an outer diameter of 20 mm or more can be smoothed by using a rotating metal roller, i. e., by flattening protrusions thereon. This method, however, can not be used for the present fixing roller because it is small and has a very thin wall to be easily deformed. Lapping with a lapping film may be considered useful to remove such small protrusions on the fixing roller but it is also considered that this lapping process may deteriorate the surface quality (i.e., increase surface roughness) of the coat 52*s*, resulting in decreasing the toner-releasing property of the fixing roller. Accordingly, the influence of the lapping process with a lapping film was examined. The fixing rollers were lapped with 4 kinds of lapping films (abrasive grain size of 30 μm to 12 μm) respectively. Each roller was used to print 60000 recording sheets in a laser printer and then tested for determining a change in the toner-releasing property of the fixing roller according to the toner-offset temperature. (The higher a temperature of occurrence of toner-offset is, the wider a range of toner-offset-free temperature is, i.e., higher the toner-releasability is.) Table 3 shows the test results.

TABLE 3

| Abrasive Size of Lapping film (μm) | Temperature (° C.) at which high-temperature toner-offset occurred | | | | Toner-offset after fixing toner images on 60000 |
|---|---|---|---|---|---|
| Prints | 0 | 20000 | 40000 | 60000 | sheets |
| Not lapped | 190 | 185 | 175 | 165 | OK |
| 30 | 190 | 160 | 150 | 140 | NG |
| 20 | 190 | 180 | 165 | 155 | NG |
| 15 | 190 | 185 | 170 | 160 | OK |
| 12 | 190 | 185 | 175 | 165 | OK |
| 30 + 15 | 190 | 180 | 165 | 155 | NG |
| 30 + 12 | 190 | 185 | 170 | 160 | OK |

Table 3 indicates that a decrease of toner-releasability of the fixing rollers processed by the lapping film with abrasive of not more than 15 μm is substantially equal to that of the non-lapped fixing roller and no toner offset occurred on them after printing 60000 sheets for aging. Consequently, it is effective to process the coated surface of the fixing rollers with a lapping film with abrasive of 15 μm or less without deterioration of toner-releasability of the fixing roller.

However, large diameter protrusions (0.5 μm or more in the present embodiment) on the coat of the fixing roller can not sufficiently be removed (or time is required to remove) by the lapping film with abrasive of not larger than 15 μm. Accordingly, we examined such a process that laps first a coated surface of the fixing roller with a coarse grain lapping film and then finely finish the same surface of the fixing roller with a fine grain lapping film. This process is intended to improve yield of high-quality products.

The test results are also shown in Table 3. A fixing roller (30+15) lapped first with a 30 μm-grain lapping film and then with a 15 μm-grain lapping film was subjected to high-temperature toner offset while a fixing roller (30+12) lapped first with a 30 μm-grain lapping film and then with a 12 μm-grain lapping film has a minimum decrease in toner-releasing property and did not suffer high-temperature toner-offset after printing 60000 sheets for aging. It was recognized that a lapping film of grain size of 15 μm to 30 μm can be applied for coarse lapping and a lapping film with of grain size of not more than 12 μm can be used for fine relapping. The lapping process can remove large protrusions from the coated surface of the fixing roller with no fear of reducing toner-releasing property of the coat and can thereby improve the quality of the fixing roller 52. Thus, the production yield of the fixing rollers 52 can be increased.

As is apparent from the foregoing, the toner fixing device according to the present invention can realize smooth and reliable transfer of a recording paper with no fear of toner offset since its fixing roller has a coat of PTFE-fluoroelastomer compound.

The method of manufacturing a toner device can produce a covering coat of the fixing roller, which coat has a stabilized toner releasability and a satisfactory wear resistance.

The method of manufacturing a toner device can remove protrusions from the covering coat of the fixing roller without impairing the surface quality, which coat can prevent the deterioration of toner releasability by aging and prevent high-temperature toner-offset.

The method of manufacturing a toner device can remove large protrusions from the covering coat of the fixing roller without decreasing the toner-releasability and can therefore improve the yield of fixing roller products and reduce production cost.

We claim:

1. A toner image fixing device comprising a fixing roller, a pressure member disposed to press against an outer circumferential surface of the fixing roller, and a heat-resistant sheet interposed between the fixing roller and the pressure member, said heat-resistant sheet being pressed by the pressure member against the fixing roller to form nip for fixing an unfixed toner image on a recording medium by the fixing roller while the recording medium passing therethrough, characterized in that the fixing roller is covered with a coat of polytetrafluoroethylene (PTFE) compounded with fluoroelastomer.

2. A toner image fixing device according to claim 1, wherein the coat of polytetrafluoroethylene compounded with fluoroelastomer is formed on a metal cylindrical support.

3. A toner image fixing device according to claim 1, wherein the pressure member is secured to a supporting member.

4. A toner image fixing device according to claim 3, wherein the supporting member is a frame.

5. A toner image fixing device according to claim 1, wherein the heat-resistant sheet is secured to a supporting member.

6. A toner image fixing device according to claim 5, wherein the supporting member is a frame.

7. A toner image fixing device according to claim 1, wherein the coat of polytetrafluoroethylene compounded with fluoroelastomer is formed on a metal cylindrical support, wherein the pressure member is secured to a supporting member, and wherein the heat-resistant sheet is secured to a supporting member.

* * * * *